US007578770B2

(12) United States Patent
Kuivala

(10) Patent No.: US 7,578,770 B2
(45) Date of Patent: Aug. 25, 2009

(54) EXERCISE DEVICE

(75) Inventor: Henri Kuivala, Pöytyä (FI)

(73) Assignee: Accell Fitness Division, B.V., Almere (NL)

( * ) Notice: Subject to any disclaimer, the term of this patent is extended or adjusted under 35 U.S.C. 154(b) by 0 days.

(21) Appl. No.: 12/010,944

(22) Filed: Jan. 31, 2008

(65) Prior Publication Data

US 2008/0188357 A1 Aug. 7, 2008

(30) Foreign Application Priority Data

Feb. 2, 2007 (FI) ..... 20075068

(51) Int. Cl.
*A63B 22/04* (2006.01)

(52) U.S. Cl. ..... 482/52; 482/57; 482/70

(58) Field of Classification Search ..... 482/52, 482/57, 70

See application file for complete search history.

(56) References Cited

U.S. PATENT DOCUMENTS 2,673,737 A * 3/1954 Daniels ..... 482/130
5,685,804 A 11/1997 Whan-Tong et al.
5,792,029 A * 8/1998 Gordon ..... 482/52
6,063,008 A * 5/2000 McBride et al. ..... 482/52
6,063,009 A * 5/2000 Stearns et al. ..... 482/52
6,090,014 A * 7/2000 Eschenbach ..... 482/52
6,183,398 B1 * 2/2001 Rufino et al. ..... 482/57
6,302,825 B1 * 10/2001 Stearns et al. ..... 482/52
6,340,340 B1 * 1/2002 Stearns et al. ..... 482/52
6,908,416 B2 * 6/2005 Mercado et al. ..... 482/52
6,926,646 B1 * 8/2005 Nguyen ..... 482/71
2004/0248707 A1 * 12/2004 Rodgers, Jr. ..... 482/83
2005/0245358 A1 * 11/2005 Mercado et al. ..... 482/52

* cited by examiner

*Primary Examiner*—Fenn C Mathew
*Assistant Examiner*—Andrew M Tecco
(74) *Attorney, Agent, or Firm*—Birch, Stewart, Kolasch & Birch, LLP

(57) ABSTRACT

An exercise device includes a right and a left belt part arranged in connection with the right and the left pedal part. The belt parts are arranged to travel as an endless loop around sheaves. A right and a left rod part, each has a first end and a second end. The right footrest is fastened to the right belt part and the left footrest to the left belt part. The first end of the right rod part is fastened to the right belt part and the second end is pivoted to the frame structure. The first end of the left rod part is fastened to the left belt part and the second end is pivoted to the frame structure.

3 Claims, 1 Drawing Sheet

EXERCISE DEVICE

BACKGROUND OF THE INVENTION

The invention relates to an exercise device comprising a frame structure arranged to be supported by a rest surface, against which frame structure a crank mechanism is arranged to be supported, which crank mechanism has a right and a left pedal part and a footrest arranged to be supported by both pedal parts and arranged movably in the direction of the pedal part; and a right and a left front rest, each having a first end and a second end, whereby the right and the left front rest are fastened turnably to the right and left pedal part by their first end, and both front rests are fastened turnably to the frame structure by the area between the first and the second end to achieve elliptical paths of movement for the foot rests, whereby the exercise device comprises a right and a left belt part arranged in connection with the right and the left pedal part, the belt parts being arranged to travel as an endless loop around sheaves; and a right and a left rod part, each of which has a first end and a second end, whereby the right footrest is fastened to the right belt part and the left footrest to the left belt part, and the first end of the right rod part is fastened to the right belt part, and the first end of the left rod part is fastened to the left belt part.

Exercise devices of the above type, i.e. crosstrainers or elliptical exercise devices, are presently well known. Such elliptical exercise devices efficiently build up body muscles and endurance. The elliptical path of movement of the feet, which is experienced as pleasant, and the movement of the hands combined with it quickly raise the heart rate to a desired level. Even paths of movement are also friendly to the user's joints.

As noted above, elliptical exercise devices mentioned above are presently well known, and different manufacturers have developed various versions. Examples of the devices known in the field include the device solutions described in U.S. Pat. Nos. 7,041,034, 6,949,053 and 6,027,431 as well as in U.S. patent application Ser. No. 2002/0198084.

The above solutions according to the state of the art work, in principle, in a satisfactory manner. A drawback of the devices according to the prior art is, however, their complex structure and also their large size. One reason for the large device size is that in the prior art, the aim of achieving a great step length has also resulted in a relatively long frame structure. Thus, the use of the devices has turned out to be difficult in some cases, particularly in smallish spaces, for example in home use.

An object of the invention is to provide an exercise device by means of which disadvantages of the prior art can be eliminated. This has been achieved by means of the exercise device according to the invention. The exercise device according to the invention is characterized in that the second end of the right rod part and the second end of the left rod part are pivoted to the frame structure.

An advantage of the invention is, above all, that the invention enables a great step length, although the length of the exercise device frame is small. Further, an advantage of the invention is its simplicity, so that manufacturing, using and maintaining the device is inexpensive.

In the following, the invention will be explained in more detail with reference to an embodiment example shown in the attached drawing, whereby

BREIF DESCRIPTION OF THE DRAWINGS

FIGS. 1 and 2 show principled side views of the exercise device according to the invention in such a way that the exercise device is at different stages of use.

DETAILED DESCRIPTION OF THE PREFERRED EMBODIMENTS

Figure 1:
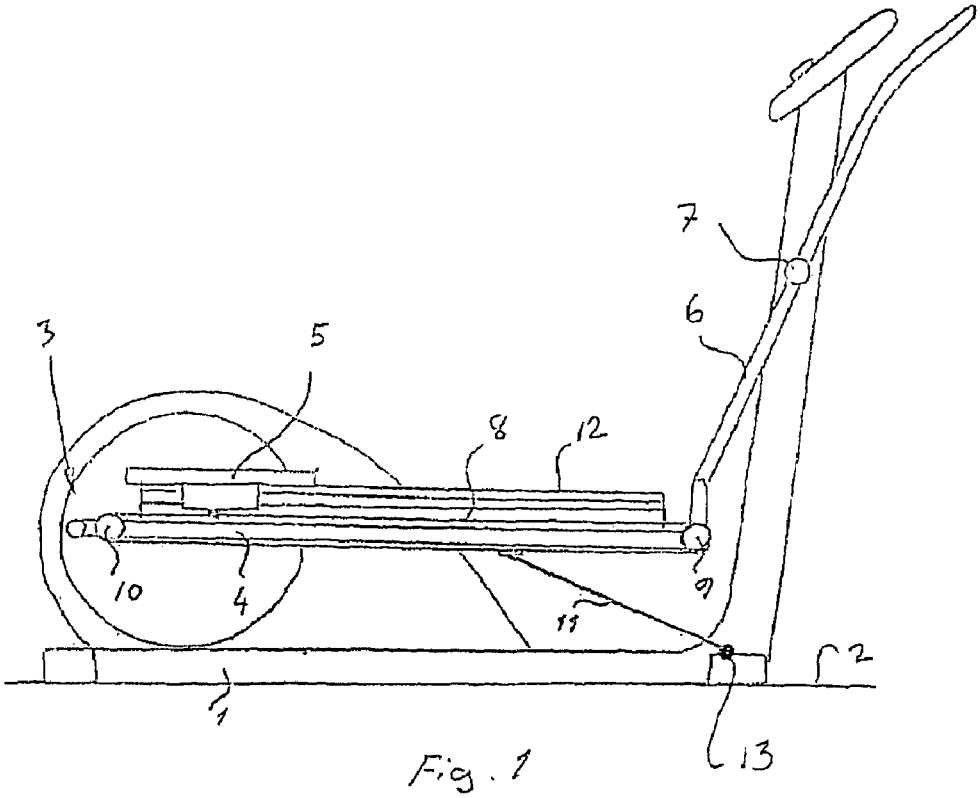
FIG. 1 shows a principled side view of an exercise device according to the invention.
Figure 2:
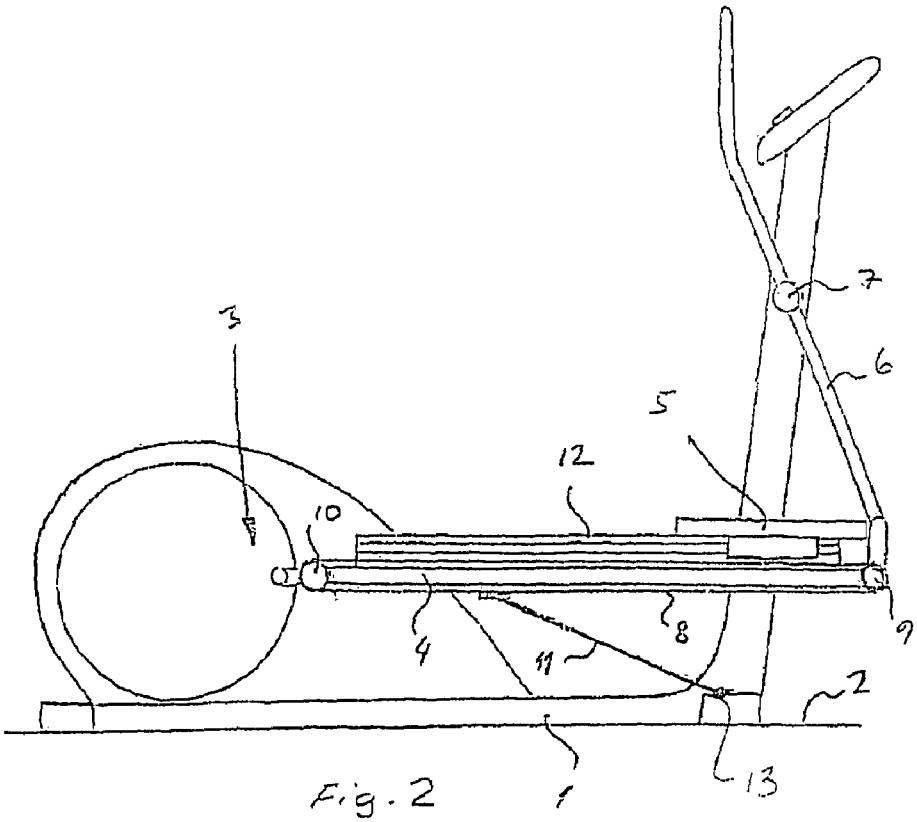
FIG. 2 shows the exercise device according to FIG. 1 at the second stage of use.

FIGS. 1 and 2 show principled side views of the exercise device according to the invention in such a way that the exercise device is at different stages of use.

The figures show with reference numeral 1 a frame structure arranged to be supported by a rest surface 2. The rest surface 2 may be a floor surface, for example.

Arranged to be supported by the frame structure 1, there is a crank mechanism 3 having a right and a left pedal part 4. The figures show only the right pedal part 4. It is obvious that the structure of the device is similar on the left side of the device.

Arranged to be supported by both pedal parts 4, there is a footrest 5 that is also arranged to move in the direction of the pedal part, in other words a right footrest is arranged in connection with the right pedal part and, correspondingly, a left footrest is arranged in connection with the left pedal part. Further, the device comprises a right and a left front support 6, both of which have a first and a second end. The right front support 6 is fastened turnably by its first end to the pedal part 4, and by the area between the first and the second end to the frame structure 1. The fastening point of the front support to the frame structure is denoted by reference numeral 7 in the figures. Correspondingly, the left front support is fastened turnably by the first end to the left pedal part, and by the area between the first and the second end to the frame structure. For the sake of clarity, the figures only show the right side of the device. It will be obvious to a person skilled in the art that the left side of the device is similar to the right side shown in the figures.

The above structure enables, in a manner known as such, an elliptical path of movement of the footrests and, at the same time, of the user's feet.

According to an essential idea of the invention, the exercise device comprises a right and a left belt part 8 arranged in connection with the right and the left pedal part 4. The belt part 8 is arranged to travel as an endless loop around sheaves 9 and 10. The device further comprises a right and a left rod part 11, each having a first end and a second end. The right footrest 5 is fastened to the right belt part 8, and the left footrest is correspondingly fastened to the left belt part. The first end of the right rod part 11 is fastened to the right belt part 8 and the second end is pivoted to the frame structure 1 at 13. The first end of the left rod part is correspondingly fastened to the left belt part, and the second end is pivoted to the frame structure. Here, too, it is to be noted that the figures only show the right side of the device. The left side that is not shown in the figures is similar to the right side shown in the figures.

The above structure enables duplication of the movement length of the footrest, in other words the belt part 8 provides an extended movement of the footrest 5 relative to the pedal part 4 in the longitudinal direction of the pedal part 4. In this way, the user's step length can be clearly increased compared with known solutions. In this context, it is also to be noted that an increase in step length is achieved in connection with a significantly shorter frame structure than in prior art solutions.

The movement increasing the user's step length is clearly shown from FIGS. 1 and 2, where the device is illustrated at different stages of use. In FIG. 1 the footrest is in the back position and in FIG. 2 in the front position. The movement is achieved by means of the belt part 8, the rod part 11 fastened to the belt part and pivoted to the frame structure 1, and the footrest 5 fastened to the belt part 8, in other words the rod part 11 is closely fixed to the frame 1 and the belt part 8 and moves the belt part, which, in turn, moves the footrest 5. The footrest on the left side naturally moves correspondingly.

In the example of the figures, the pedal part 4 is provided with a slide part 12, against which the footrest 5 is supported. Any suitable element may be used as the slide part 12, for example a profile rail.

The above embodiment example of the invention is not intended to restrict the invention in any way but the invention may, within its basic idea, be modified completely freely. Thus, it is obvious that the exercise device according to the invention or its details need not necessarily be as shown in the figures but that other kinds of solutions are also feasible. For instance the crank mechanism, pedal parts, footrests, slide parts, front supports and frame structure or one or some of these may be designed to be different from those shown in the figures.

The invention claimed is:

1. An exercise device, comprising:

a frame structure arranged to be supported by a rest surface;

a crank mechanism arranged be supported against the frame structure, the crank mechanism having a right and a left pedal part and a right and left footrest arranged to be supported by the right and left pedal parts, respectively, the right and left footrests being arranged movably in a longitudinal direction of the right and left pedal parts;

a right and a left front rest, each of the right and left front rests having a first end and a second end, the right and the left front rests being fastened turnably to the right and left pedal parts by first ends thereof, respectively, and the right and left front rests being fastened turnably to the frame structure by an area between the first and second ends of the right and left front rests, respectively, to achieve elliptical paths of movement for the right and left foot rests;

a right and a left belt part arranged in connection with the right and the left pedal parts, respectively, the right and left belt parts being arranged to travel as endless loops around sheaves; and a right and a left rod part, each of the right and left rod parts having a first end and a second end, wherein the right footrest is fastened to the right belt part and the left footrest is fastened to the left belt part, the first end of the right rod part is fastened to the right belt part, the first end of the left rod part is fastened to the left belt part, and the second end of the right rod part and the second end of the left rod part are pivoted to the frame structure.

2. The exercise device according to clam 1, wherein a each of the right and left pedal parts is provided with a slide part, the right and left footrests being supported against the slide parts, respectively.

3. The exercise device according to claim 2 wherein each of the slide parts is a profile rail.

* * * * *